US006808099B2

(12) United States Patent
Nykoluk

(10) Patent No.: US 6,808,099 B2
(45) Date of Patent: Oct. 26, 2004

(54) STERNUM STRAP ATTACHMENT

(75) Inventor: Cory O. Nykoluk, Ballwin, MO (US)

(73) Assignee: Cerf Bros. Bag Co., Earth City, MO (US)

( * ) Notice: Subject to any disclaimer, the term of this patent is extended or adjusted under 35 U.S.C. 154(b) by 22 days.

(21) Appl. No.: 10/353,710

(22) Filed: Jan. 29, 2003

(65) Prior Publication Data

US 2004/0144822 A1 Jul. 29, 2004

(51) Int. Cl.[7] ..... A45F 3/04
(52) U.S. Cl. ..... 224/638; 224/262
(58) Field of Search ..... 224/637, 638, 224/639, 262, 578

(56) References Cited

U.S. PATENT DOCUMENTS

| | | | | | |
|---|---|---|---|---|---|
| 268,932 | A | * | 12/1882 | Poirier | 224/181 |
| 5,961,014 | A | * | 10/1999 | Knerr | 224/259 |
| 6,179,175 | B1 | * | 1/2001 | Painter | 224/153 |
| 6,607,107 | B2 | * | 8/2003 | Dexheimer | 224/604 |

* cited by examiner

*Primary Examiner*—Stephen K. Cronin
(74) *Attorney, Agent, or Firm*—Polster, Lieder, Woodruff & Lucchesi, L.C.

(57) ABSTRACT

The present disclosure provides a backpack comprising a pair of shoulder straps, a plurality of attachment loops attached to at least a peripheral edge of the shoulder straps and a sternum strap removably attached to the attachment loops.

14 Claims, 2 Drawing Sheets

STERNUM STRAP ATTACHMENT

BACKGROUND OF THE INVENTION

In the past, sternum straps for backpacks have been known. Generally, sternum straps are used to attach the two shoulder straps of a backpack across the sternum of the wearer and prevent the straps from sliding off the shoulders of the wearer or to an uncomfortable or unsafe position.

Referring to FIG. 5, prior art sternum straps generally comprise a length of material 100 sewn to a face 102 of backpack shoulder straps 104 at opposite ends A and B thereof. A sternum strap 106 then attaches to each length of material 100 by looping around the length of material 100 and being sewn to itself. In this manner the sternum strap 106 slides between point A and B and cannot be held in any single position along the length of material 100. The sternum strap 106 further includes a buckle 108. As can be see from the FIG. 5, the sternum strap 106 of the prior art attaches to the face 102 of the shoulder strap 104. This causes the sternum strap to provide a rotating force to shoulder strap 104 such that the shoulder strap 102 no longer lies flat on the chest and shoulders of the wearer. In turn this causes the backpack wearer to suffer discomfort as well as causing the back pack to have a poor appearance.

SUMMARY OF THE INVENTION

In its most broad aspect the present invention comprises a backpack comprising a pair of shoulder straps, a plurality of attachment loops attached to at least a peripheral edge of the shoulder straps and a sternum strap removably attached to the attachment loops.

DESCRIPTION OF THE PREFERRED EMBODIMENT

Figure 1:
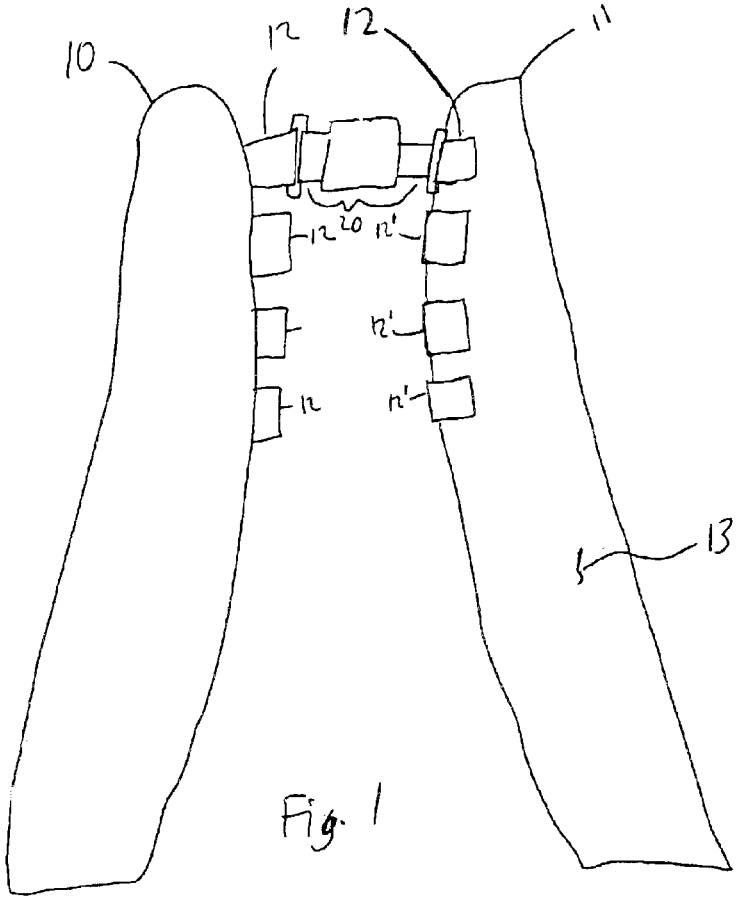
FIG. 1 is a plan view of shoulder straps and sternum strap according to an embodiment of the present invention.

While the invention is susceptible of embodiment in many different forms, there is shown in the drawings and described in detail preferred embodiments of the invention. It is to be understood that the present disclosure is to be considered only as an example of the principles of the invention. This disclosure is not intended to limit the broad aspect of the invention to the illustrated embodiments. The scope of protection should only be limited by the claims.

Referring to FIG. 1, there is shown a pair of shoulders straps 10, 11 for use with a backpack. Attached to the straps 10, 11 are a plurality of sternum strap attachment loops 12 and 12'. The shoulder straps 10, 11 are constructed by sewing or otherwise attaching two pieces of material at the outer periphery of the shoulder straps 10, 11 of FIG. 1. For the purposes of the patent application, it shall be understood the term peripheral edge or periphery of the shoulder straps shall be defined as the general outer periphery of the shoulder straps as viewed in FIG. 1. The sternum strap attachment loops 12 are attached by placing the loops 12 between the pieces of material of the shoulder straps 10, 11 before they are sewn together. The loops 12 are then placed between the pieces of material when sewing the two halves of the shoulder straps 10, 11 together.

Figure 5A:
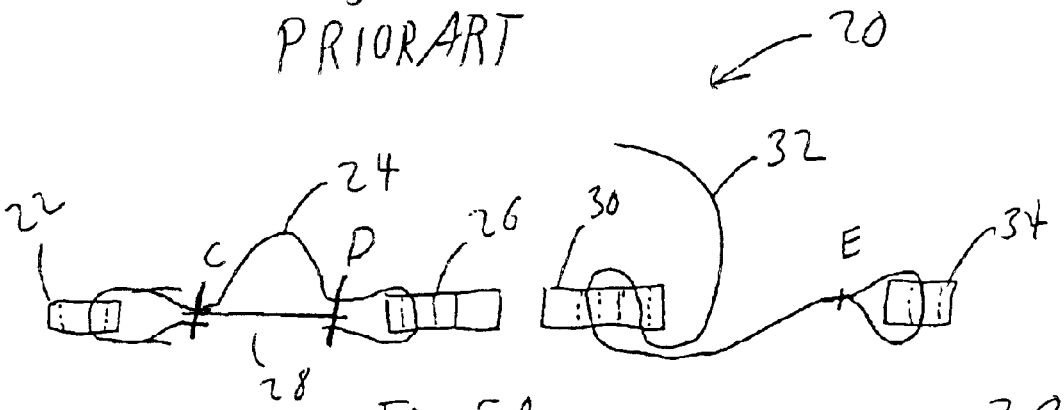
FIGS. 5A and 5B are a side and top plan views of a sternum, strap used in accordance with the present invention.
Figure 5B:
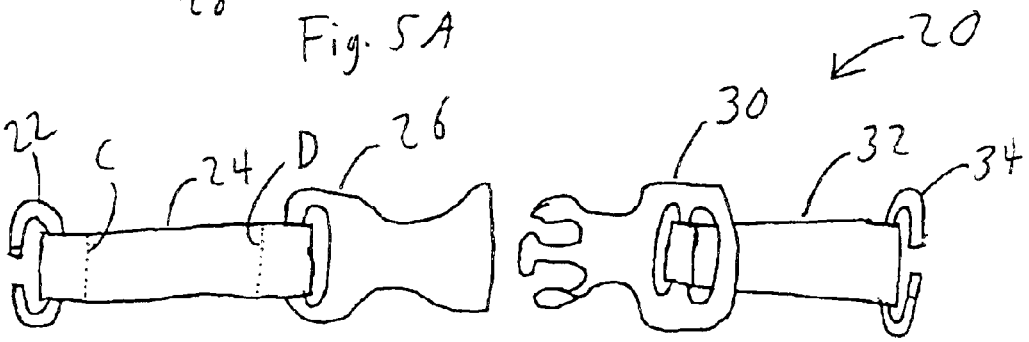
Figure 1:
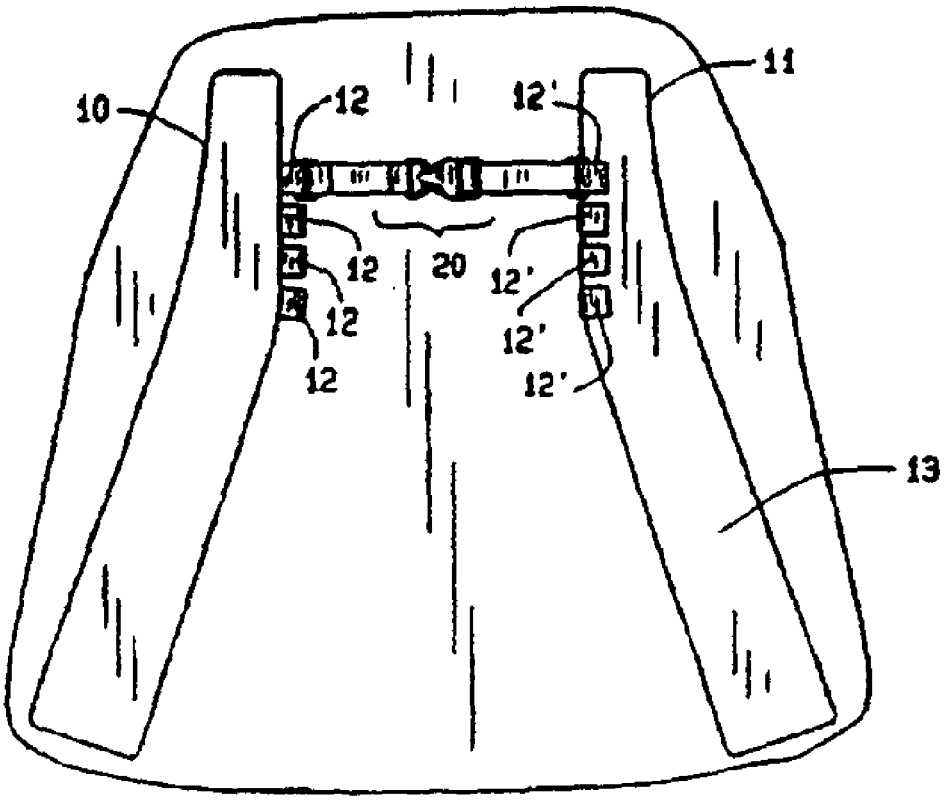
Figure 2:
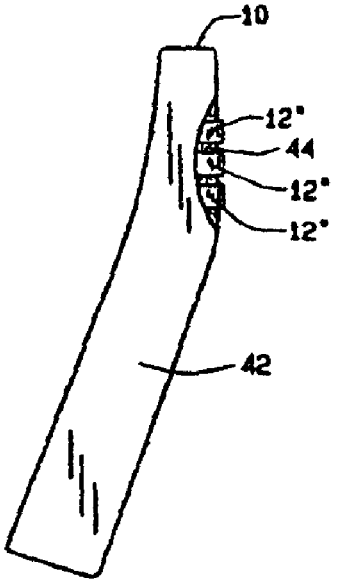
Figure 3:
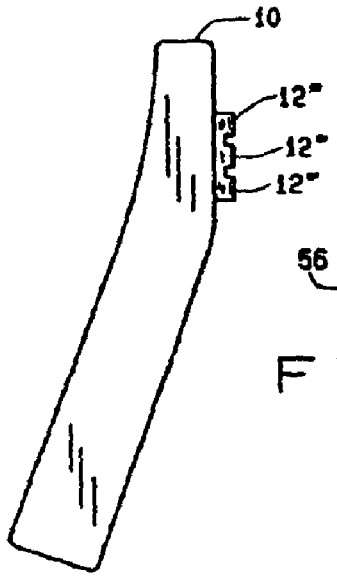
Figure 4:
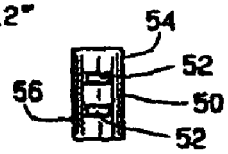
Figure 5A:
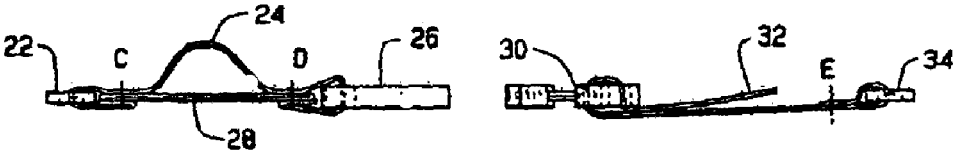
Figure 5B:
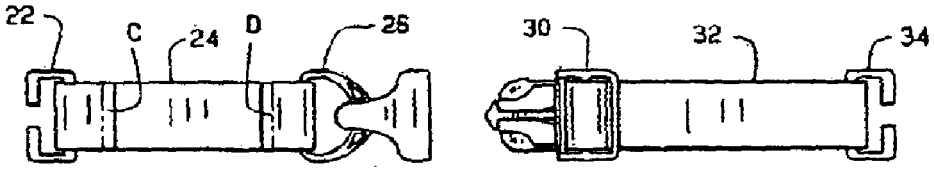
Figure 6:
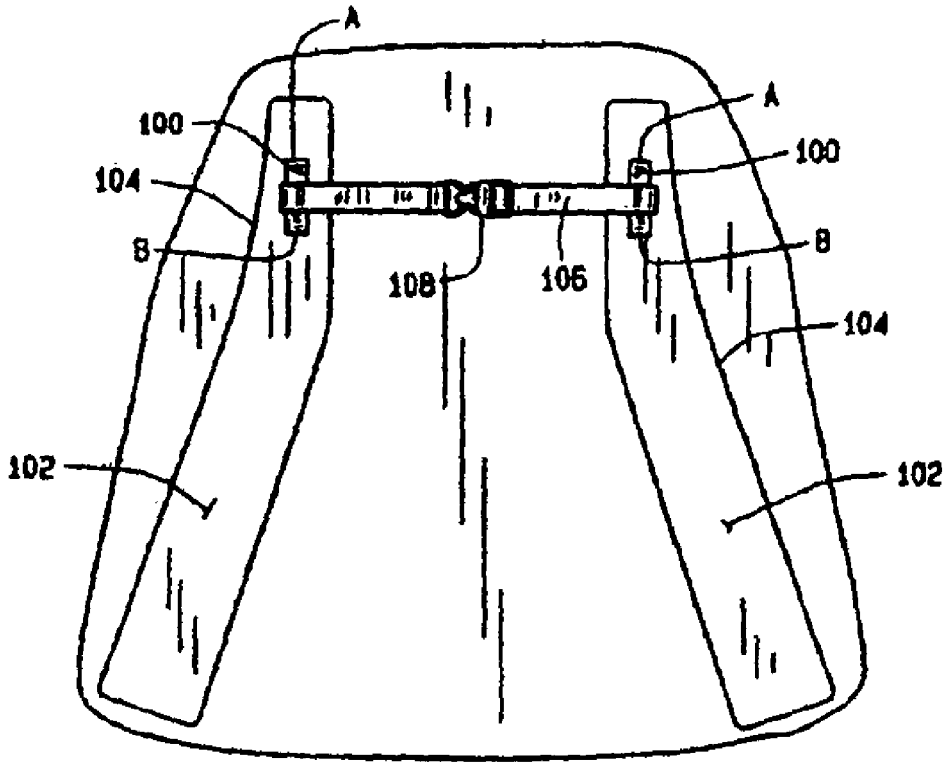
FIG. 6 PRIOR ART

Referring to FIGS. 5A and 5B, a sternum strap 20 according to the present invention is shown. The sternum strap 20 comprises a first C-clip 22 attached to a length of material 24 forming a first strap 24. The strap 24 is threaded through the C-clip 22 and sewn to itself at location C. The strap 24 is further threaded through a first buckle portion 26 and sewn to itself at a location D. Also attached to the strap 24 is an elastic portion 28. The elastic portion 28 is attached to the strap 24 at the locations C and D and, in its unstretched length, is shorter than a length of the strap 24. A second buckle portion 30 is attached to a length of material forming a second strap 32 that threaded through it. The strap 32 is further threaded through a second C-clip 34 and sewn to itself at a location E. The strap 32 threads through the second buckle portion 30 such that the maximum distance between the buckle 30 and C-clip 34 may be adjusted, as is known in the art. The first buckle portion 26 and second buckle portion 30 are removably attachable, as is also known in the art. The strap 24 and the elastic portion 28 are sewn together to provide an expanding tensioning portion such that the sternum strap 20 will not fit loosely across the wearer's chest but will expand to allow movement of the wearer without excessive tightness of the straps 24, 32.

Referring back to FIG. 1, the sternum strap 20 is attachable to the attachment loops 12 by inserting the attachment loop into the opening formed by the C-clips 22 or 34. In this manner the sternum strap pulls only upon the edge the shoulder strap 10 and does not provide a rotating force to the shoulder strap 10.

The attachment loops 12 may also be attached to the shoulder strap 10 as shown in conjunction with shoulder strap 11. As with shoulder strap 11, the attachment loops 12' are attached by sewing one end of the attachment loop into the seam of the shoulder strap as with shoulder strap 10 and sewing a second end of the shoulder strap to a face 13 of the shoulder strap 11. In this manner the attachment loops 12' are more tightly conform to the profile of the shoulder strap and may provide an appearance that is more pleasing to some wearers. The C-clips 22, 34 are attached to the attachment loops 12' in the same manner as the attachment loops 12.

Figure 2:
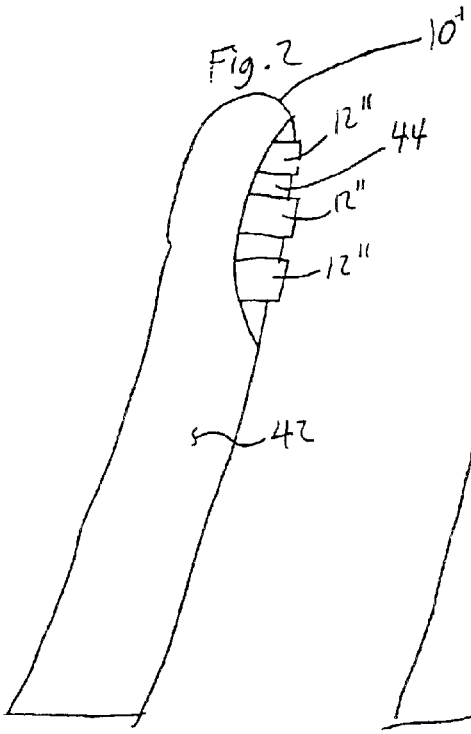
FIG. 2 is a plan view of a shoulder strap according to another embodiment of the present invention.

Referring to FIG. 2, the attachment loops 12 may also be attached to the shoulder strap 10' as shown with respect to attachment loops 12". With shoulder strap 10' a front portion 42 of the shoulder strap 10' is sewn to a second front portion 44. The attachment loops 12" are attached to the shoulder strap 10' by sewing one end of the attachment loops 12" into the seam between the front and back portions of the shoulder strap 10' as with the shoulder strap 10 of FIG. 1 and sewing the second end of the attachment loop 12" into the seam where the front portion 42 and the second front portion 44 are sewn together. In this manner the tight conformity of the attachment loop 12" to the periphery of the shoulder strap 10' is maintained and while adding the benefit of hiding the ends of the attachment loops 12" from view.

Figure 3:
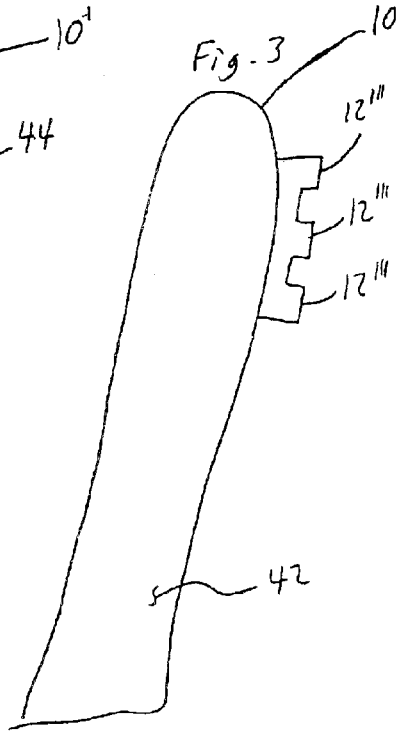
FIG. 3 is a plan view of a shoulder strap according to another embodiment of the present invention.
Figure 4:
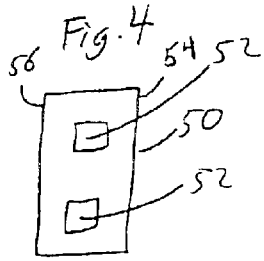
FIG. 4 is a plan view of attachment loops used with the shoulder strap embodiment of FIG. 3.
Figure 6:
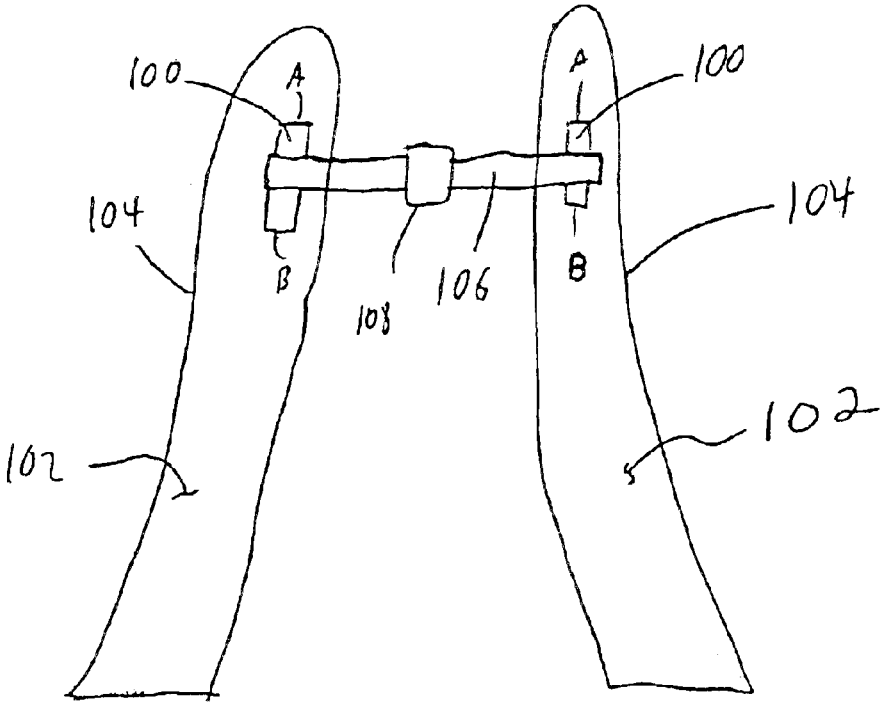
Fig. 6 PRIOR ART
FIG. 6 is a plan view of shoulder straps and a sternum strap according to the prior art.

Referring to FIGS. 3 and 4, an alternative method of providing the attachment loops 12 is provided. In FIGS. 3 and 4, attachment loops 12''' are provided by single a single piece of material 50. The material has one or more holes 52 cut within it. When a right side 54 of the material 50 is folded over onto a left side 56 of the material and sewn between the seam attaching the front portion 42 of the shoulder strap 10 and the rear portion of the shoulder strap 10, attachment loops 12''' are formed.

While it is shown and described that a front and a back portion of the shoulder straps comprises two pieces of material sewn together is should further be understood the front and the back portion of the shoulder strap could comprise a single piece of material folded over upon itself and sewn along a portion of the periphery of the shoulder strap nearest the opposite shoulder strap without departing from the scope of the present invention.

While the specific embodiments have been illustrated and described, numerous modifications come to mind without significantly departing from the spirit of the invention, and the scope of protection is only limited by the scope of the accompanying claims.

I claim:

1. A backpack comprising:

a pair of shoulder straps;

a plurality of attachment loops attached to at least a peripheral edge of the shoulder straps; and a sternum strap removably attached to the attachment loops.

2. The backpack of claim 1 wherein the shoulder straps each comprise two pieces of material sewn together at the peripheral edge of each shoulder strap and the attachment loops are attached to each shoulder strap by sewing them between the two pieces of material.

3. The backpack of claim 2 wherein the sternum strap is attached to the attachment loops to each shoulder strap by the use of C-clips.

4. The backpack of claim 1 wherein the shoulder straps each comprise two pieces of material sewn together at the peripheral edge of each shoulder strap and the attachment loops are attached to each shoulder strap by sewing a first end of the attachment loop between the two pieces of material and sewing a second end of the attachment loop to a face of the shoulder strap.

5. The backpack of claim 4 wherein the sternum strap is attached to the attachment loops to each shoulder strap by the use of C-clips.

6. The backpack of claim 1 wherein the shoulder straps each comprise three pieces of material wherein the two of the pieces are sewn together to form a front portion of the shoulder strap and the third piece of material form a back portion of the shoulder strap wherein the front piece of material is sewn to the back piece of material to form the shoulder strap and wherein the attachment loops are sewn at one end between the front and back pieces of material and sewn at another end between the two piece that form the front portion of the shoulder strap.

7. The backpack of claim 6 wherein the sternum strap is attached to the attachment loops to each shoulder strap by the use of C-clips.

8. The backpack of claim 1 wherein the shoulder straps each comprise two pieces of material sewn together at the peripheral edge of each shoulder strap and the attachment loops comprise a piece of material having at least one cutout portion in a central region thereof and wherein the material is doubled over upon itself and sewn between the front and back portions of the shoulder strap.

9. The backpack of claim 8 wherein the sternum strap is attached to the attachment loops to each shoulder strap by the use of C-clips.

10. A backpack comprising:

a first shoulder strap having a plurality of attachment loops having at least one end attached directly to a periphery of the first shoulder strap;

a second shoulder strap having a plurality of attachment loops having at least one end attached directly to a periphery of the second shoulder strap; and a sternum strap removably attached to one of the attachment loops of the first shoulder strap and removably attached to one of the attachment loops of the second shoulder strap.

11. The backpack of claim 10 wherein the attachment of the sternum strap to the attachment loops of the first and second shoulder straps is accomplished by a "C" clip.

12. The backpack of claim 10 wherein the sternum strap further comprises a buckle.

13. The backpack of claim 10 wherein the attachment loops are attached to the shoulder strap by sewing first and second ends of the attachment loop between front and rear pieces of material forming the shoulder strap.

14. The back of claim 10 wherein the attachment loops are attached to the shoulder strap by sewing first ends between front and rear pieces of material forming the shoulder strap and a second end of the attachment loop.

* * * * *

UNITED STATES PATENT AND TRADEMARK OFFICE

CERTIFICATE OF CORRECTION

PATENT NO. : 6,808,099 B2
DATED : October 26, 2004
INVENTOR(S) : Cory O. Nykoluk It is certified that error appears in the above-identified patent and that said Letters Patent is hereby corrected as shown below:

Delete Title page and substitute the title page as shown on attached page.

Drawings,
Delete Figs. 1-6 and substitute Figs. 1-6, as shown on the attached pages.

Signed and Sealed this

Thirteenth Day of June, 2006

JON W. DUDAS
*Director of the United States Patent and Trademark Office*

(12) United States Patent
Nykoluk

(10) Patent No.: US 6,808,099 B2
(45) Date of Patent: Oct. 26, 2004

(54) STERNUM STRAP ATTACHMENT

(75) Inventor: Cory O. Nykoluk, Ballwin, MO (US)

(73) Assignee: Cerf Bros. Bag Co., Earth City, MO (US)

( * ) Notice: Subject to any disclaimer, the term of this patent is extended or adjusted under 35 U.S.C. 154(b) by 22 days.

(21) Appl. No.: 10/353,710

(22) Filed: Jan. 29, 2003

(65) Prior Publication Data

US 2004/0144822 A1 Jul. 29, 2004

(51) Int. Cl.[7] ..... A45F 3/04
(52) U.S. Cl. ..... 224/638; 224/262
(58) Field of Search ..... 224/637, 638, 224/639, 262, 578

(56) References Cited

U.S. PATENT DOCUMENTS

| | | | | |
|---|---|---|---|---|
| 268,932 | A * | 12/1882 | Poirier | 224/181 |
| 5,961,014 | A * | 10/1999 | Knerr | 224/259 |
| 6,179,175 | B1 * | 1/2001 | Painter | 224/153 |
| 6,607,107 | B2 * | 8/2003 | Dexheimer | 224/604 |

* cited by examiner

*Primary Examiner*—Stephen K. Cronin
(74) *Attorney, Agent, or Firm*—Polster, Lieder, Woodruff & Lucchesi, L.C.

(57) ABSTRACT

The present disclosure provides a backpack comprising a pair of shoulder straps, a plurality of attachment loops attached to at least a peripheral edge of the shoulder straps and a sternum strap removably attached to the attachment loops.

14 Claims, 2 Drawing Sheets

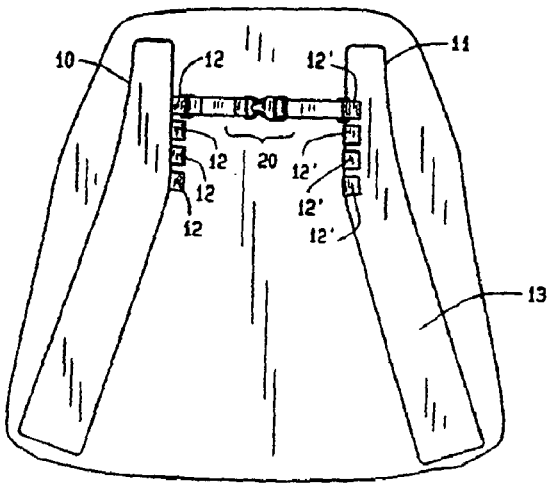

[redacted]